US007191994B2

(12) United States Patent
Johnson et al.

(10) Patent No.: US 7,191,994 B2
(45) Date of Patent: Mar. 20, 2007

(54) BRACE ASSEMBLY FOR CEILING FANS AND FIXTURES

(75) Inventors: Steven J. Johnson, Galien, MI (US); Krzysztof W. Korcz, Granger, IN (US)

(73) Assignee: Hubbell Incorporated, Orange, CT (US)

( * ) Notice: Subject to any disclaimer, the term of this patent is extended or adjusted under 35 U.S.C. 154(b) by 172 days.

(21) Appl. No.: 10/651,205

(22) Filed: Aug. 29, 2003

(65) Prior Publication Data

US 2005/0045793 A1 Mar. 3, 2005

(51) Int. Cl.
*A47H 1/10* (2006.01)

(52) U.S. Cl. ..... 248/343; 248/906; 248/909

(58) Field of Classification Search ..... 248/343, 248/342, 200.1, 906, 909
See application file for complete search history.

(56) References Cited

U.S. PATENT DOCUMENTS

| | | | | |
|---|---|---|---|---|
| 3,104,087 | A | 9/1963 | Budnick et al. | |
| 3,163,386 | A | 12/1964 | Collins | |
| 3,214,126 | A | 10/1965 | Roos | |
| 4,050,603 | A * | 9/1977 | Harris et al. | 220/3.9 |
| 4,062,512 | A * | 12/1977 | Arnold | 248/309.1 |
| 4,165,851 | A | 8/1979 | Bowden, Jr. et al. | |
| 4,967,990 | A * | 11/1990 | Rinderer | 248/205.1 |
| 5,074,515 | A | 12/1991 | Carter, Jr. | |
| 5,150,868 | A * | 9/1992 | Kaden | 248/343 |
| 5,303,894 | A | 4/1994 | Deschamps et al. | |
| 5,720,461 | A | 2/1998 | Kerr, Jr. | |
| 5,782,438 | A * | 7/1998 | Hubben et al. | 248/27.3 |
| 5,934,631 | A | 8/1999 | Becker et al. | |
| 5,938,157 | A | 8/1999 | Reiker | |
| 5,954,304 | A | 9/1999 | Jorgensen | |
| 6,237,884 | B1 | 5/2001 | Howe | |
| 6,332,597 | B1 | 12/2001 | Korcz et al. | |
| 6,464,524 | B1 | 10/2002 | Kerr, Jr. et al. | |
| 2002/0027185 | A1 | 3/2002 | Lee et al. | |
| 2003/0006353 | A1 | 1/2003 | Dinh et al. | |

* cited by examiner

*Primary Examiner*—Ramon O Ramirez
(74) *Attorney, Agent, or Firm*—Marcus R. Mickney; Alfred N. Goodman; Mark Bicks

(57) ABSTRACT

A brace assembly supports an outlet box that receives an electrical fixture. A first brace member has a first base. A second brace member has a second base and is adjustably received by the first brace member. A first mounting surface extends from the base of the first brace member. The first mounting surface forms a first angle greater than 90 degrees with the first base. A second mounting surface extends from the second base of the second brace member. The second mounting surface forms a second angle greater than 90 degrees with the second base. The angled mounting surfaces provide a compression fit between the brace assembly and supports to which the first and second brace members are secured.

6 Claims, 7 Drawing Sheets

BRACE ASSEMBLY FOR CEILING FANS AND FIXTURES

FIELD OF THE INVENTION

The present invention relates to a brace assembly for ceiling fans and fixtures. More particularly, the present invention relates to a brace assembly having a mounting surface that extends more than 90 degrees from a brace member to create a compression fit between the brace member and the support. Still more particularly, the present invention relates to a brace assembly having first and second brace members, each brace member having a mounting surface that extends more than 90 degrees from the brace member to create a compression fit between the brace member and the supports.

BACKGROUND OF THE INVENTION

Ceiling fan and fixture braces exist that support outlet boxes and the like. The braces are installed between supports, such as trusses or joists, in the ceiling. However, existing braces are generally awkward to install. Generally, installing existing braces requires the installer to measure and mark installation points on the supports. The brace must then be visually aligned with that installation point on the supports. Securing the brace to the supports becomes difficult if the installer did not have the brace in the correct or desired position when marking the installation points. A need exists for a brace assembly that does not require physically marking installation points on the supports.

Another problem with existing braces is that the installer must physically hold the brace in position with one hand while trying to secure the brace to the supports with fasteners. Some existing braces provide prongs that may be hammered into the supports with one hand while the installer's other hand supports the brace in its installation position. Still other existing braces provide double-faced tape to temporarily support the brace in place while the installer securely fastens the brace to the supports. Those existing braces are awkward and inefficient to install and require a great deal of dexterity on the part of the installer. A need exists for a brace assembly that is easily and efficiently installed and secured to supports.

Existing braces are disclosed in U.S. Pat. No. 3,163,386 to Collins; U.S. Pat. No. 4,165,851 to Bowden, Jr. et al.; and U.S. Pat. No. 5,303,894 to Deschamps et al. For example, as shown in FIGS. 1 and 2 of the Collins patent, the prongs 21 are hammered to drive the prongs 24 into the joists 11. As shown in FIGS. 2*b* and 5 of the Bowden patent, the tabs 42 are hammered into joists 51 and 52 to temporarily secure the brace between the joists. As shown in FIG. 1 of the Deschamps patent, the tubes 10 and 12 are temporarily secured by hammering plates 14 and 16 to drive spikes 15 into the joists. Thus, temporarily securing the braces to the joists requires dexterity and tools. A need exists for a brace assembly that is temporarily secured between supports simply and without tools.

Thus, there is a continuing need to provide improved brace assemblies to support outlet boxes.

SUMMARY OF THE INVENTION

Accordingly, it is a primary objective of the present invention to provide an improved brace assembly to support an outlet box.

A further objective of the present invention is to provide a brace assembly that is easily and efficiently temporarily secured between supports.

A still further objective of the present invention is to provide a brace assembly that is temporarily secured between supports without tools.

A still further objective of the present invention is to provide a brace assembly that is not awkward to temporarily secure between supports.

The foregoing objects are basically attained by providing a brace assembly that supports an outlet box. A brace member is adapted to be installed between first and second support members. The brace member has a base. A first mounting surface extends from the base at a first end of the brace member. The first mounting surface forms a first angle greater than 90 degrees with the base.

The foregoing objects are also basically attained by providing a brace assembly that supports an outlet box. A first brace member has a first base. A second brace member has a second base and is adjustably received by the first brace member. A first mounting surface extends from the base of the first brace member. The first mounting surface forms a first angle greater than 90 degrees with the first base. A second mounting surface extends from the second base of the second brace member. The second mounting surface forms a second angle greater than 90 degrees with the second base.

Other objects, advantages and salient features of the invention will become apparent from the following detailed description, which, taken in conjunction with the annexed drawings, closes preferred embodiments of the invention.

BRIEF DESCRIPTION OF THE DRAWINGS

Referring now to the drawings that form a part of the original disclosure.

DETAILED DESCRIPTION OF THE INVENTION

Figure 1:
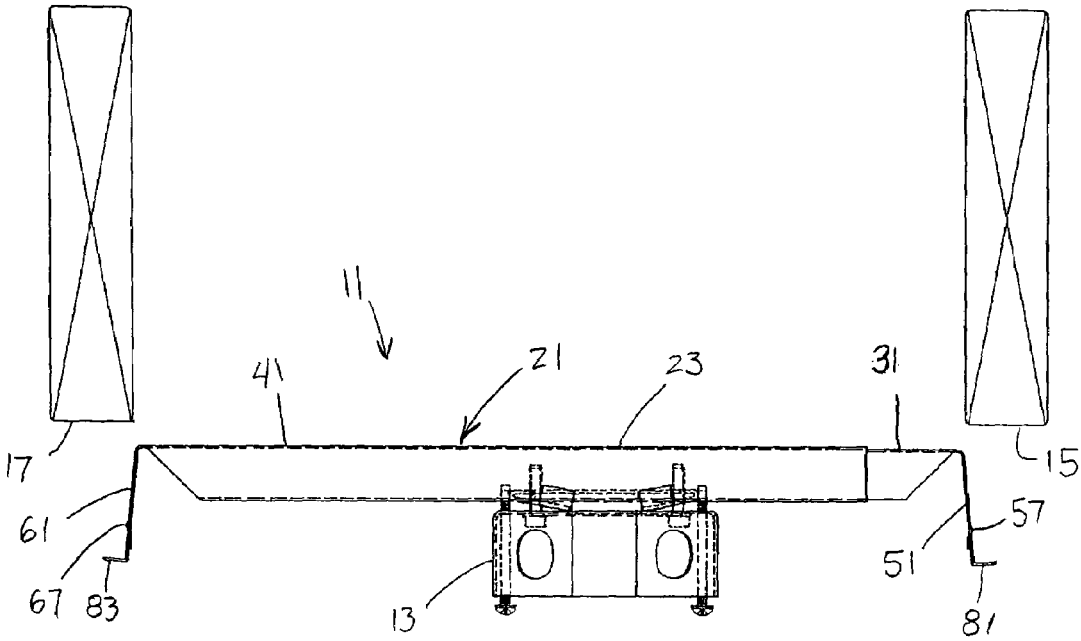
FIG. 1 is a side elevational view of the brace assembly according to the present invention prior to insertion between two supports.

As seen in FIGS. 1–13, the brace assembly 11 in accordance with the present invention supports an outlet box 13. A brace member 21 is adapted to be installed between first and second support members 15 and 17. The brace member 21 has a base 23. A first mounting surface 51 extends from the base 21 at a first end of the brace member 21. The first mounting surface 51 forms a first angle $\alpha$ greater than 90 degrees with the base 23.

The brace member 21 is adapted to be installed between first and second support members 15 and 17, as shown in FIGS. 1–2 and 10–13. Preferably, the brace member 21 has a first, or inner, brace member 41 and a second, or outer, brace member 31. The second brace member 31 is slidably received by the first brace member 41, as shown in FIGS. 1–2 and 10–13, to provide an adjustable brace assembly 11. The first brace member 41 is movable relative to the second brace member 31 so that the brace assembly 11 may be adjusted to fit between first and second supports 15 and 17 of various widths.

Figure 3:
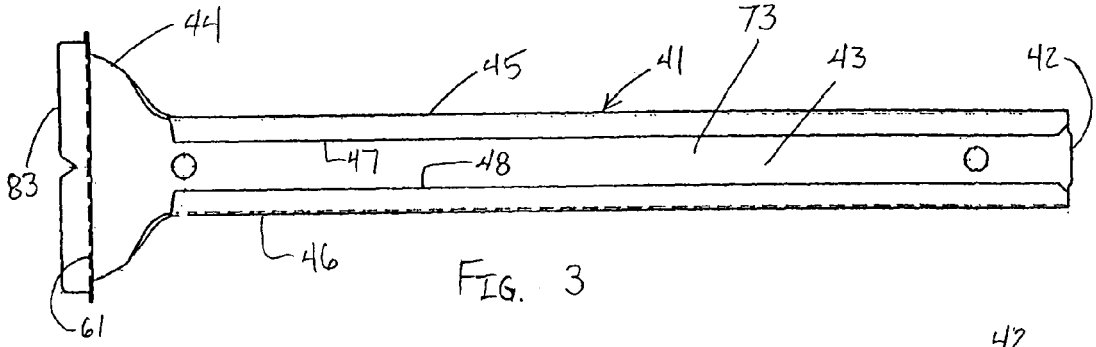
FIG. 3 is a bottom plan view of a first brace member of the brace assembly of FIG. 1.
Figure 4:
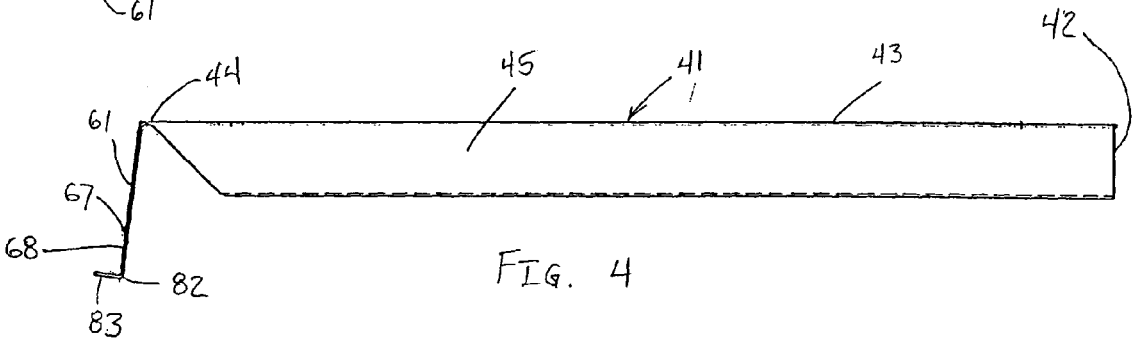
FIG. 4 is a side elevational view of the first brace member of FIG. 2 with the mounting surface shown in an installed position.
Figure 5:
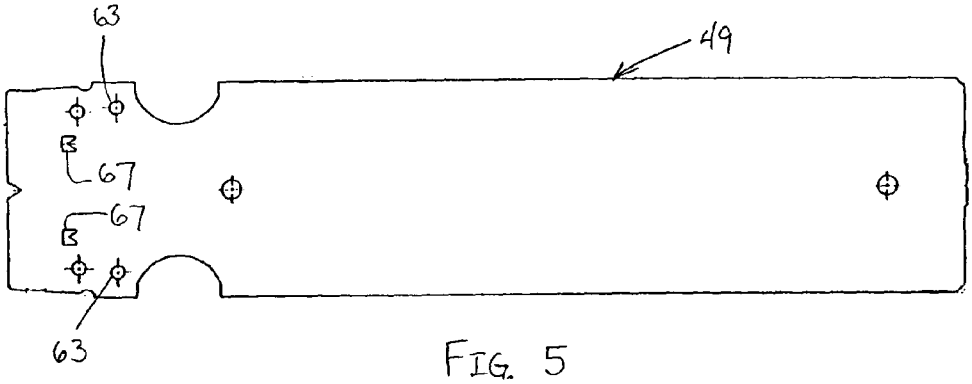
FIG. 5 is a top plan view of a flat blank used to construct the first brace member of FIG. 1.

First brace member 41, FIGS. 3–5, has a base 43 and first and second ends 42 and 44, respectively. Side walls 45 and 46 extend downwardly substantially perpendicularly from the base 43 of the first brace member 41. The side walls 45 and 46 extend along the length of the first brace member from the first end 42 to the second end 44. Lips 47 and 48 extend inwardly substantially perpendicularly from each of the side walls 45 and 46, as shown in FIG. 3. Preferably, the first brace member 41 is made from a flat sheet of metal 49, such as galvanized steel, as shown in FIG. 5.

Figure 7:
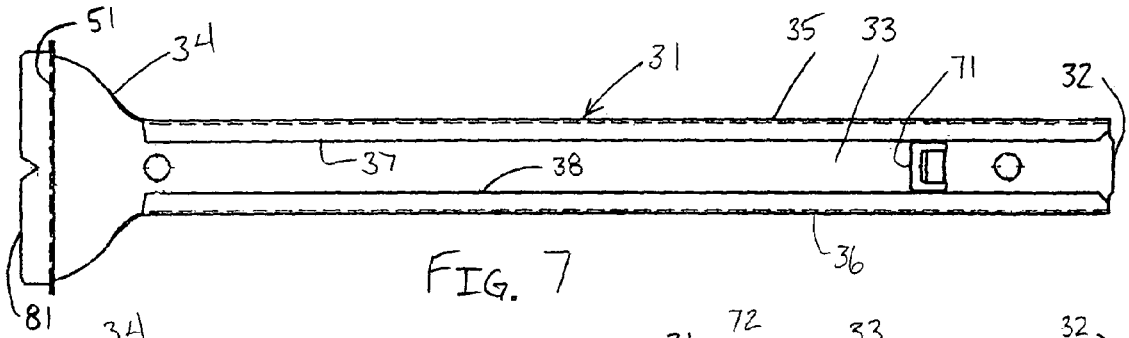
FIG. 7 is a bottom plan view of a second brace member of the brace assembly of FIG. 1.
Figure 8:
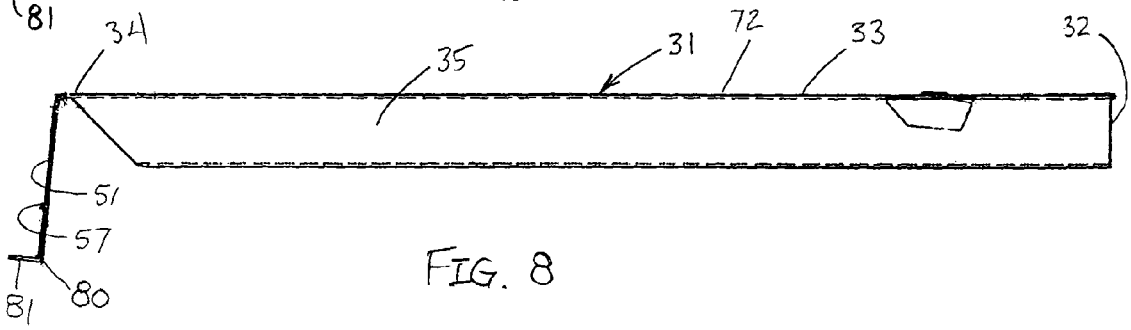
FIG. 8 is a side elevational view of the second brace member of FIG. 7 with the mounting surface shown in an installed position.
Figure 9:
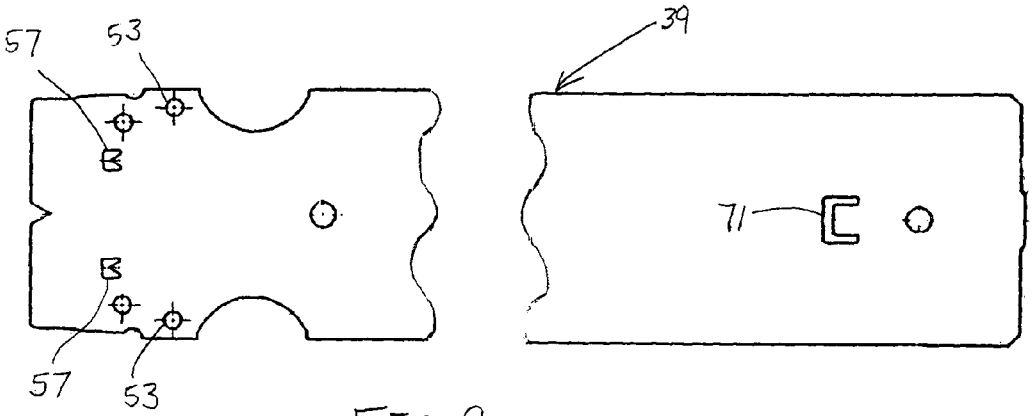
FIG. 9 is a top plan view of a flat blank used to construct the second brace member of FIG. 7.

Second brace member 31, FIGS. 7–9, has a base 33 and first and second ends 32 and 34, respectively. Side walls 35 and 36 extend downwardly substantially perpendicularly from the base 33 of the second brace member 31. The side walls 35 and 36 extend along the first brace member from the first end 32 to the second end 34. Lips 37 and 38 extend inwardly substantially perpendicularly from each of the side walls 35 and 36, as shown in FIG. 7. Preferably, the second brace member 31 is made from a flat sheet of metal 39, such as galvanized steel, as shown in FIG. 9. The first end 42 of the first brace member 41 receives the first end 32 of the second brace member 31 so that an outer surface 72 of the second brace member is proximal the inner surface 73 of the first brace member.

A tab 71 extends upwardly from an outer surface 72 of the second brace member 31, as shown in FIGS. 7 and 8. The tab 71 provides a friction fit between the first and second brace members 41 and 31. The friction created by the tab 71 between the inner surface 73 of the first brace member 41 and the outer surface 72 of the second brace member 31 substantially prevents movement of the second brace member relative to the first brace member.

Figure 2:
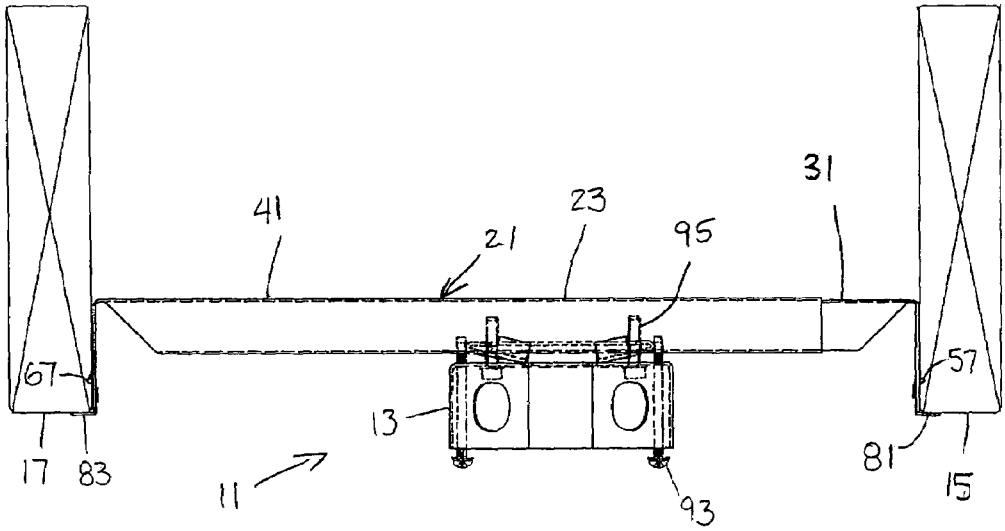
FIG. 2 is a side elevational view of the brace assembly of FIG. 1 installed between two supports.
Figure 6:
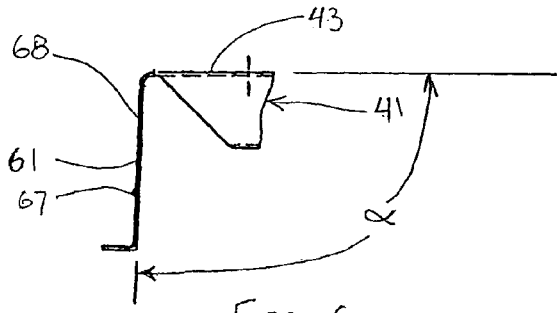
FIG. 6 is an enlarged side elevational view of a mounting surface and mounting flange of a brace member in the insertion position

A first mounting surface 61 extends downwardly from the second end 44 of the first brace member 41, as shown in FIGS. 3 and 4. The first mounting surface 61 forms an angle greater than 90 degrees with the base 43 of the first brace member 41, as shown in FIGS. 1, 4 and 6. Preferably, the angle formed is approximately 94 degrees. The first mounting surface 61 is shown in FIGS. 2 and 3 in an installed position, i.e., substantially perpendicular to the second end 44 of the first brace member 41 because of the first support 15 to which the first mounting surface is connected. First fastener holes 63 in the first mounting surface 61 receive fasteners 55 to secure the first brace member 41 to the first support 15. Score lines 69 and 60 (FIG. 10) on the first mounting surface 61 allow a portion of the first mounting surface to be removed to obtain proper positioning of the brace assembly 11 for various wall thicknesses. Any suitable method may be used to allow a portion of the first mounting surface to be removed, including, but not limited to, score lines and shear lines.

A second mounting surface 51 extends downwardly from the second end 34 of the second brace member 31, as shown in FIGS. 7 and 8. The second mounting surface 51 forms an angle greater than 90 degrees with the base 53 of the second brace member 31 similar to the first brace member 41 shown in FIG. 6. Preferably, the angle formed is approximately 94 degrees. The second mounting surface 51 is shown in FIGS. 2 and 7 in an installed position, i.e., substantially perpendicular to the second end 34 of the second brace member 31 because of the second support 15 to which the second mounting surface is connected. Second fastener holes 53 in the second mounting surface 51 receive fasteners (not shown) to secure the second brace member 31 to the second support 17. Score lines 59 and 50 (FIG. 10) on the second mounting surface 51 allow a portion of the second mounting surface to be removed to obtain proper positioning of the brace assembly 11 for various wall thicknesses. Any suitable method may be used to allow a portion of the second mounting surface to be removed, including, but not limited to, score lines and shear lines.

First prongs 67 extend from the outer surface 68 of the first mounting surface 61. Second prongs 57 extend from the outer surface 58 of the second mounting surface 51. The prongs 67 and 57 are positioned at an angle to the supports 15 and 17, thereby allowing the pressure created by the compression fit of the brace member 21 and the force of gravity to cause the prongs to dig into the supports and provide a secure fit between the brace member and the supports.

A first flange 83 extends substantially perpendicularly outwardly from the first mounting surface 61, as shown in FIGS. 3 and 4. Preferably, the first flange 83 extends from a lower end 82 of the first mounting surface 61. The first flange 83 contacts the first support 15 to facilitate proper vertical positioning of the brace assembly 11 to the support 15.

A second flange 81 extends substantially perpendicularly outwardly from the second mounting surface 51, as shown in FIGS. 7 and 8. Preferably, the second flange 81 extends from a lower end 80 of the second mounting surface 51. The second flange 81 contacts the second support 17 to facilitate proper vertical positioning of the brace assembly 11 to the support 17.

Preferably, the first and second brace members 41 and 31 are made of a metal, such as galvanized steel.

Assembly and Disassembly

As shown in FIG. 2, the brace assembly 11 is fully constructed and installed between supports 15 and 17. An outlet box 13 is secured to the brace assembly 11 to receive a fan or other electrical fixture.

Figure 10:
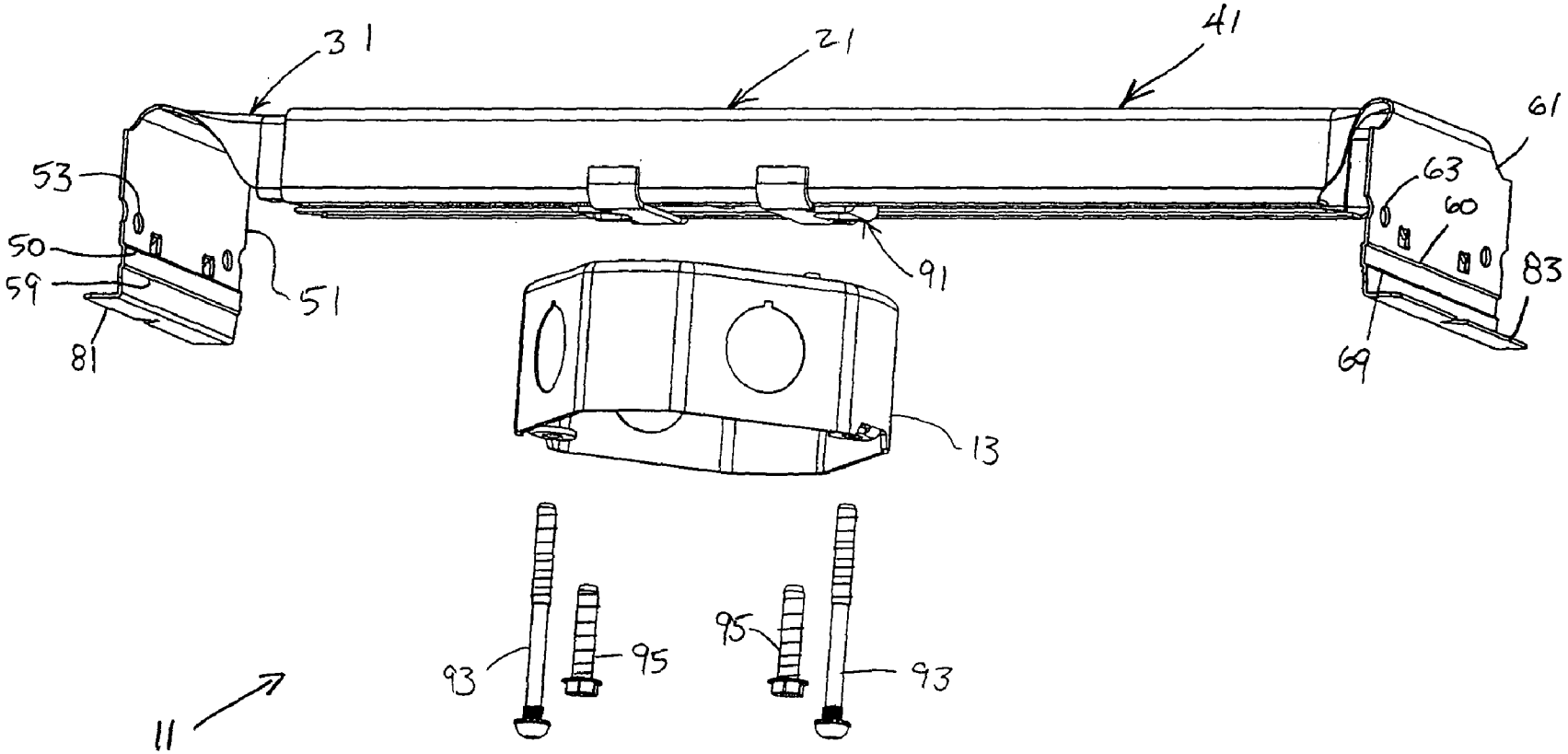
FIG. 10 is a perspective view of the brace assembly of the present invention in which the mounting surfaces have score lines to accommodate various wall thicknesses.

A bracket 91 is positioned on the brace member 21, as shown in FIG. 10. The bracket 91 is slid over the lips 47 and 48 of the first brace member 41 (FIG. 3). The first end 42 of the first brace member 41 receives the first end 32 of the second brace member 31. The tab 71 of the second brace member 31 creates a friction fit between the first and second brace members, thereby preventing substantial movement of one brace member with respect to the other. The outlet box 13 is then secured to the bracket 91 of the brace member 21 with fasteners 95. Fasteners 93 may be slightly threaded into the outlet box 13 to hold the fasteners in the outlet box until the fasteners are needed to secure an electrical fixture or fan to the outlet box.

Figure 11:
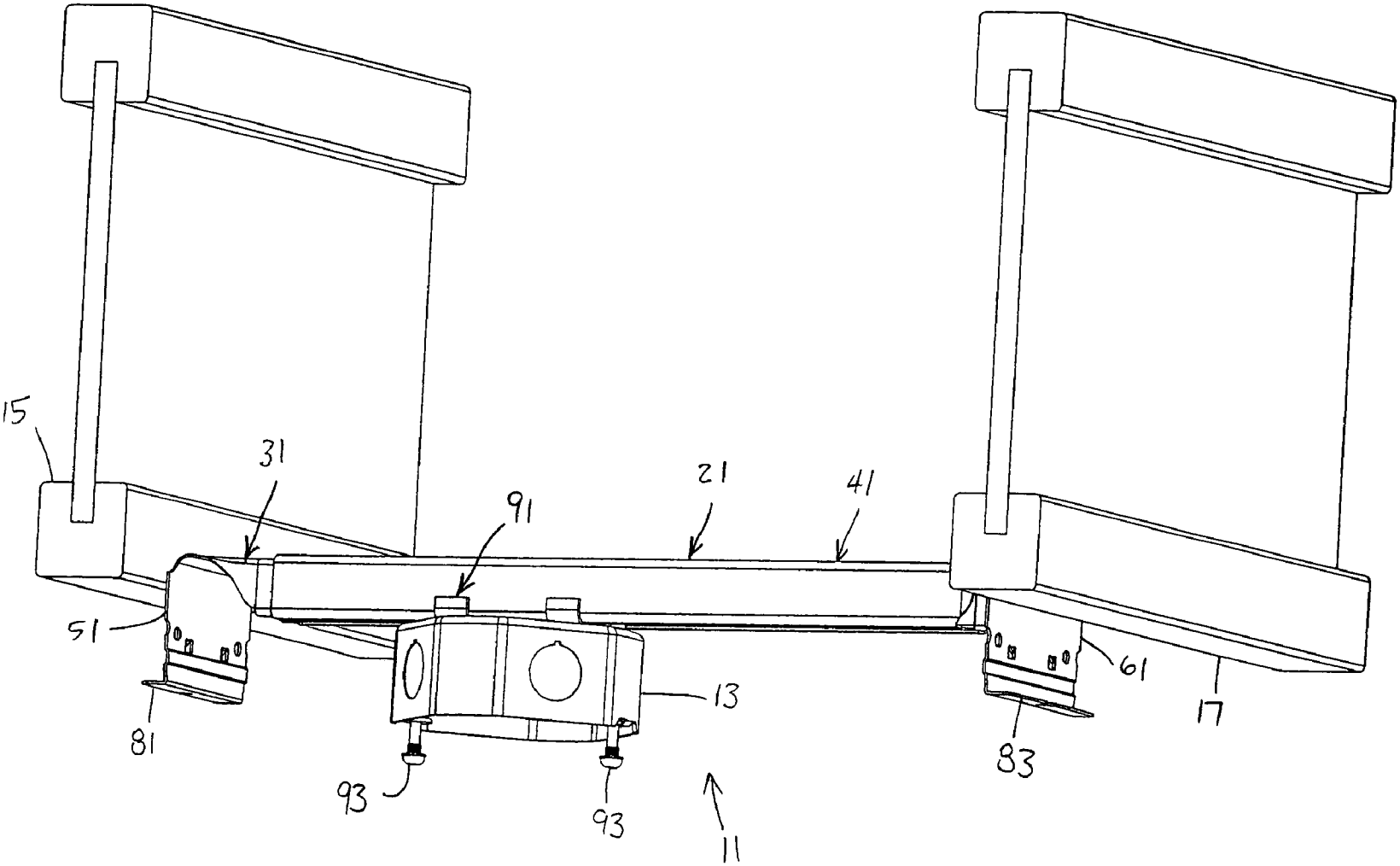
FIG. 11 is a perspective view of the brace assembly of FIG. 10 prior to securing the brace assembly between two supports.

The brace assembly 11 is then raised between first and second supports 15 and 17, as shown in FIGS. 1 and 11. The first and second brace members 41 and 31 are expanded laterally relative to one another until the first and second mounting surfaces 61 and 51, opposite ends 82 and 80, contact the first and second supports 15 and 17.

Figure 12:
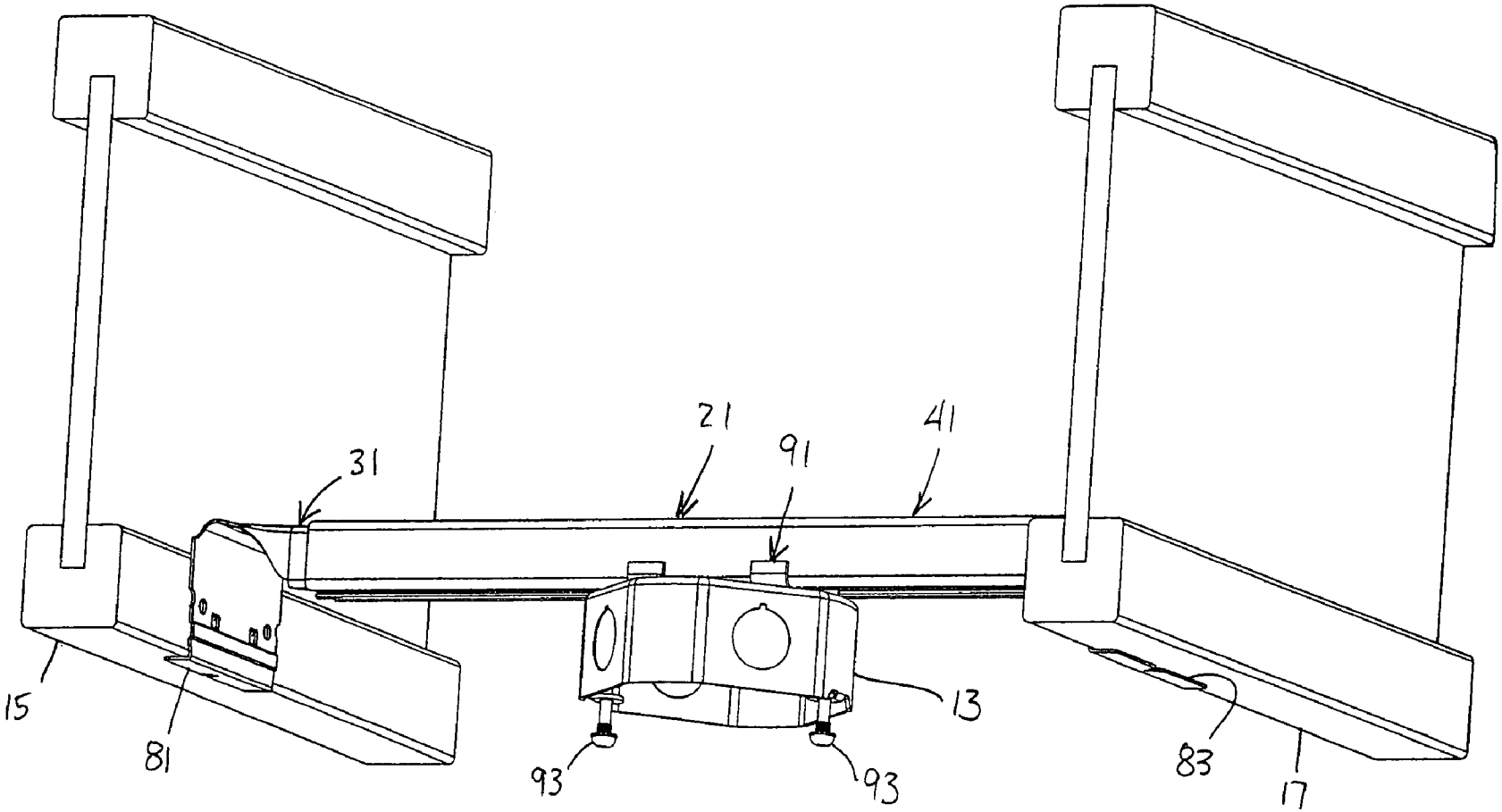
FIG. 12 is a perspective view of the brace assembly of FIG. 10 in which the brace members have been extended so that the mounting surfaces contact the supports to create a compression fit between the brace assembly and the supports.

Once the first and second brace members 41 and 31 have been expanded so that the first and second mounting surfaces 61 and 51 contact the first and second supports 15 and 17, the brace member 21 is raised up until the first and second flanges 81 and 83 contact the first and second supports 15 and 17, respectively, as shown in FIGS. 2 and 12. When the first and second mounting surfaces 61 and 51 contact the first and second supports 15 and 17, the mounting surfaces are pivoted inwardly. The angle á between the mounting surfaces and their respective bases 43 and 33 is decreased, thereby creating a compression fit between the brace member 21 and the first and second supports 15 and 17. The mounting surfaces 61 and 51 being forced inwardly creates a compression fit between the brace member 21 and the supports 15 and 17, so that the installer may release the brace member without the brace member falling. Additionally, prongs 67 and 57 dig into the supports 15 and 17 to further facilitate retention of the brace member 21 between the supports without requiring the installer to use a hand to hold the brace member in place. To accommodate various wall thicknesses, the first and second mounting surfaces 61 and 51 may have a portion removed at the score lines 60, 69, 50 and 59 (FIG. 10) so that the brace member 21 does not sit as high with respect to the supports to accommodate various wall thicknesses.

Figure 13:
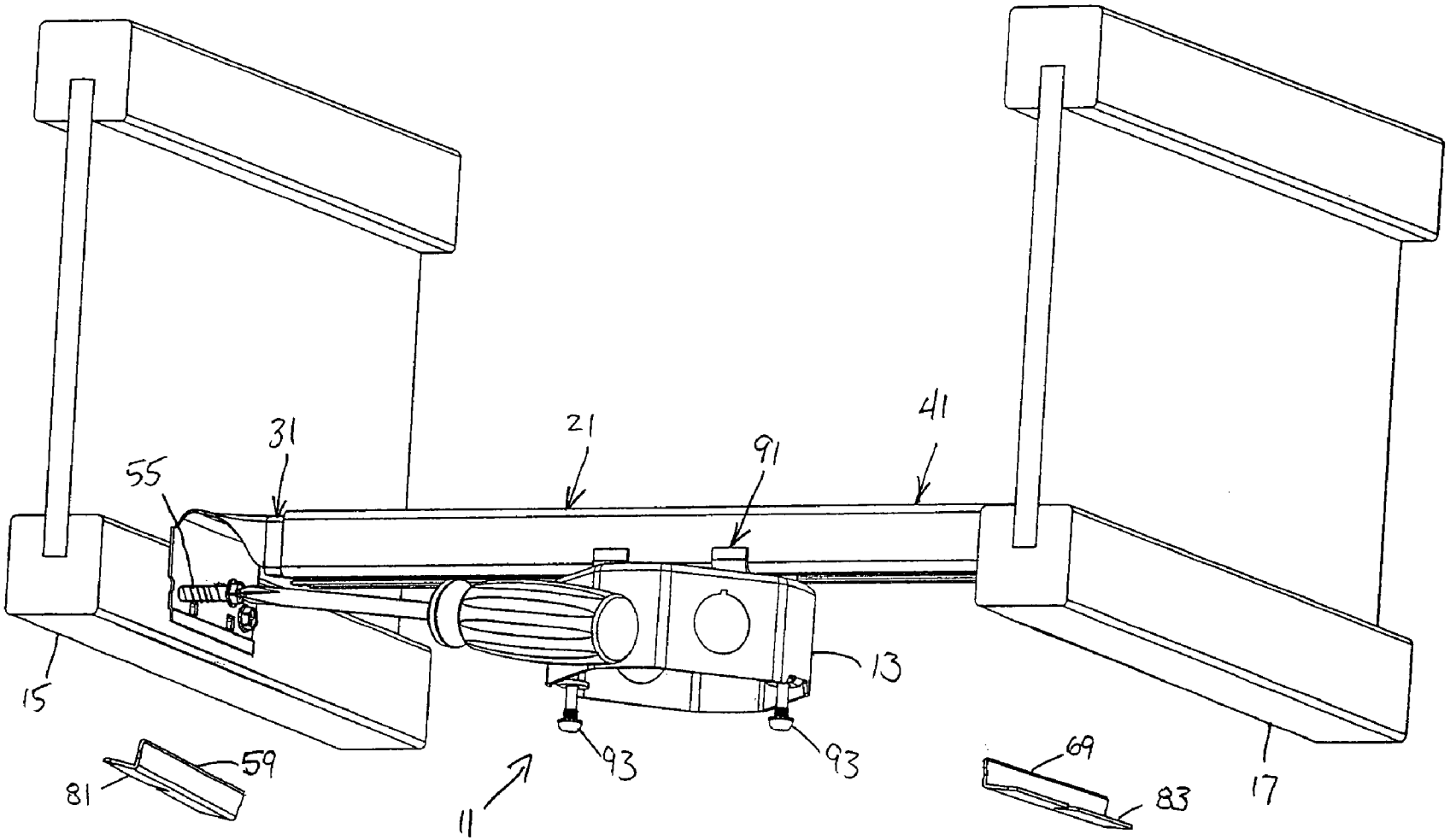
FIG. 13 is a perspective view of the brace assembly of FIG. 10 in which a mounting surface is receiving a fastener to secure the brace assembly to the supports.

Fasteners 55 are inserted through fastener holes 63 and 53 in the first and second mounting surfaces 61 and 51 to secure the brace member 21 between the supports 15 and 17, as shown in FIG. 13. The fasteners 55 may be easily inserted into the supports since the installer does not need to keep one hand on the brace member 21 to hold it in place. Fasteners 93 may then be removed to secure an electrical fixture to the outlet box 13.

While advantageous embodiments have been chosen to illustrate the invention, it will be understood by those skilled in the art that various changes and modifications may be made therein without departing from the scope of the invention as defined in the appended claims.

What is claimed is:

1. An adjustable brace assembly to support an outlet box, comprising:

a first brace member having a first base;

a second brace member having a second base, said second brace member being adjustably received by said first brace member;

a first mounting surface extending from said first base of said first brace member, said first mounting surface forming a first angle greater than 90 degrees with said first base;

a second mounting surface extending from said second base of said second brace member, said second mounting surface forming a second angle greater than 90 degrees with said second base;

a first fastener hole in said first mounting surface to receive a first fastener to secure said first brace member to a first support member;

a second fastener hole in said second mounting surface to receive a second fastener to secure said second brace member to a second support member;

a first flange extending perpendicularly outwardly from said first mounting surface and adapted to be received on a lower surface of the first support member;

a second flange extending perpendicularly outwardly from said second mounting surface and adapted to be received on a lower surface of the second support member; and a tab extending outwardly from an outer surface of said second base of said second brace member, said tab contacting an inner surface of said first base of said first brace member to create an interference fit between said first and second brace members.

2. A brace assembly according to claim 1, wherein said first angle is approximately 94 degrees.

3. A brace assembly according to claim 2, wherein said second angle is approximately 94 degrees.

4. A method of installing a brace assembly between first and second supports, comprising the steps of:

positioning the brace assembly between the first and second supports;

extending the brace assembly between the first and second supports;

raising the brace assembly between the first and second supports to flex inwardly first and second mounting surfaces of the brace assembly to create a compression fit between the brace assembly and the first and second supports;

raising the brace assembly until each of said first and second mounting flanges on the first and second mounting surfaces contact an underside of each of the first and second supports;

releasing the brace assembly; and inserting fasteners through the first and second mounting surfaces to secure the brace assembly to the first and second supports.

5. A method of installing a brace assembly according to claim 4, further comprising inserting prongs on the first and second mounting surfaces into the first and second supports to secure the brace assembly to the first and second supports.

6. A method of installing a brace assembly according to claim 4, further comprising breaking each of the first and second mounting surfaces at a score line to accommodate various wall thicknesses.

* * * * *